US006280276B1

(12) United States Patent
Bucher et al.

(10) Patent No.: US 6,280,276 B1
(45) Date of Patent: Aug. 28, 2001

(54) METHOD OF ATTACHING A TENSION MASK TO A FRAME

(75) Inventors: Alan Weir Bucher; Frank Rowland Ragland, Jr., both of Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/461,656

(22) Filed: Dec. 14, 1999

(51) Int. Cl.[7] ..... H01J 29/07; H01J 9/02
(52) U.S. Cl. ..... 445/30
(58) Field of Search ..... 445/30

(56) References Cited

U.S. PATENT DOCUMENTS

| | | | | |
|---|---|---|---|---|
| 3,638,063 | * | 1/1972 | Tachikawa et al. | 313/348 |
| 4,333,034 | * | 6/1982 | Ohgoshi et al. | 313/407 |
| 4,745,328 | | 5/1988 | Strauss | 313/402 |
| 4,950,945 | | 8/1990 | Fendley et al. | 313/407 |
| 5,111,106 | | 5/1992 | Kaplan et al. | 313/403 |
| 5,681,197 | * | 10/1997 | Egami et al. | 445/30 |
| 6,106,353 | * | 8/2000 | Kimura et al. | 445/30 |

OTHER PUBLICATIONS

PCT Search Report dated: Mar. 28, 2001.

* cited by examiner

*Primary Examiner*—Kenneth J. Ramsey
(74) *Attorney, Agent, or Firm*—Joseph S. Tripoli; Dennis H. Irlbeck

(57) ABSTRACT

The present invention provides a method of attaching a tension mask to a frame to achieve desired tensions at a plurality of locations across the mask, wherein the frame has two opposite sides between which the mask is to be attached. Specific forces are applied from each of a plurality of separate actuators at positions, along each of the two opposite sides of the frame, that affect the mask tensions respectively at the plurality of locations across the mask. Each of the actuators is individually controlled to apply a specific force to a frame side that is directly related to the desired mask tension required at a particular mask location. While the specific forces are applied by the actuators, the mask is attached to the two opposite sides of the frame. Thereafter, the forces on the sides are released.

6 Claims, 1 Drawing Sheet

METHOD OF ATTACHING A TENSION MASK TO A FRAME

This invention relates to a method of fabricating a tension mask type of color picture tube, and particularly to a method of applying pressure to a tension mask frame to obtain a desired tension distribution in the mask when it is attached thereto.

BACKGROUND OF THE INVENTION

A color picture tube includes an electron gun for generating and directing three electron beams to the screen of the tube. The screen is located on the inner surface of a faceplate of the tube and is made up of an array of elements of three different color-emitting phosphors. A color selection electrode, which may be either a shadow mask or a focus mask, is interposed between the gun and the screen to permit each electron beam to strike only the phosphor elements associated with that beam.

One type of color picture tube has a tension mask mounted within a faceplate panel thereof. In order to maintain the tension on the mask, the mask must be attached to a support frame. In making a tension mask-frame assembly, the mask is attached to the frame while the frame is held in a compressed condition. After attachment of the mask to the frame, such as by welding, the frame compression is released, so that the frame springs outwardly to tension the mask. The conventional method for compressing the frame is to press on the frame members with blades shaped to provide the proper frame deflection for the desired mask tension distribution. Slight distortions of the frame, especially in frames made of relatively thin material, can result in undesirable uneven tensioning of the mask. Such undesirable variations in tension arise because of the conventional method reliance on fixed displacement inputs to the frame to provide a tension distribution.

SUMMARY OF THE INVENTION

The present invention provides a method of attaching a tension mask to a frame to achieve desired tensions at a plurality of locations across the mask, wherein the frame has two opposite sides between which the mask is to be attached. In the method, specific forces are applied from each of a plurality of separate actuators at positions, along each of the two opposite sides of the frame, that affect the mask tensions respectively at the plurality of locations across the mask. Each of the actuators is individually controlled to apply a specific force to a frame side that is directly related to the desired mask tension required at a particular mask location. While the specific forces are applied by the actuators, a mask is attached to the two opposite sides of the frame.

DETAILED DESCRIPTION OF THE PREFERRED EMBODIMENT

Figure 1:
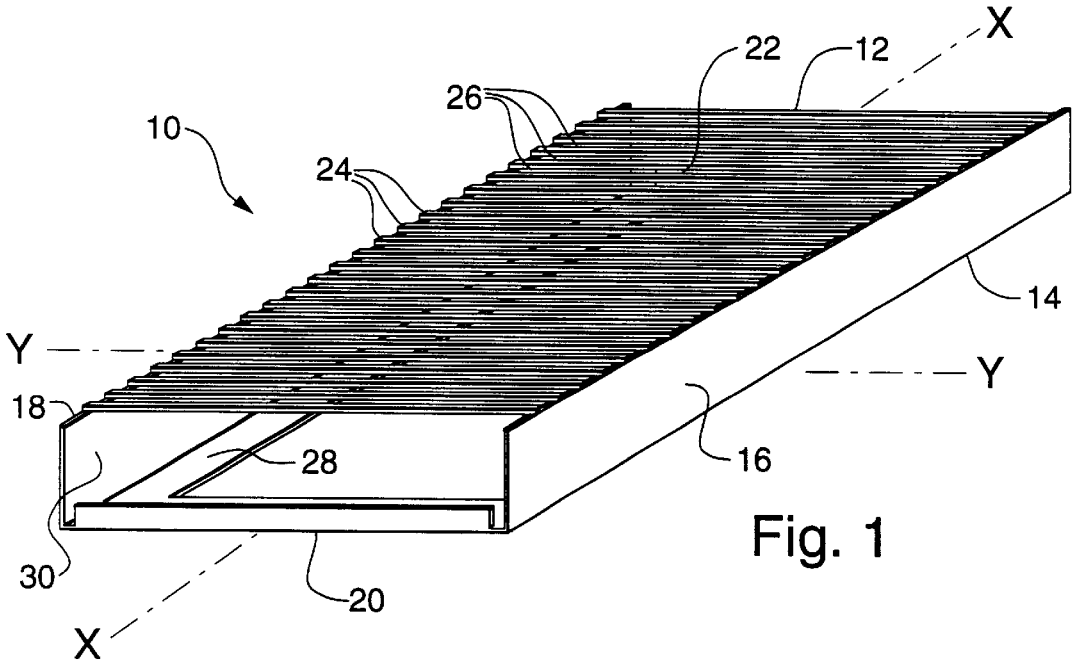
FIG. 1 is a perspective view of a tension mask-frame assembly.

FIG. 1 shows a tension mask-frame assembly 10, wherein a tension mask 12 is attached to a peripheral frame 14 that includes two long sides 16 and 18, and two short sides 20 and 22. The two long sides 16 and 18 parallel a central major axis, X, of the assembly 10; and the two short sides 20 and

22 parallel a central minor axis, Y, of the assembly 10. The tension mask 12 includes an apertured portion that contains a plurality of metal strips 24 having a multiplicity of elongated slits 26 therebetween that parallel the minor axis, Y. All of the slits 26 extend between the two long sides 16 and 18 of the frame 14. Alternatively, the strips 24 could be connected by a plurality of tie bars, which would break up continuity of the slits 26. Each of the two long sides 16 and 18 of the frame 14 includes two flanges, a first flange 28 in the X-Y plane and a second flange 30 extending perpendicular to the first flange 28. The tension mask 12 is attached to the distal edges of the two second flanges 30, such as by welding.

Figure 2:
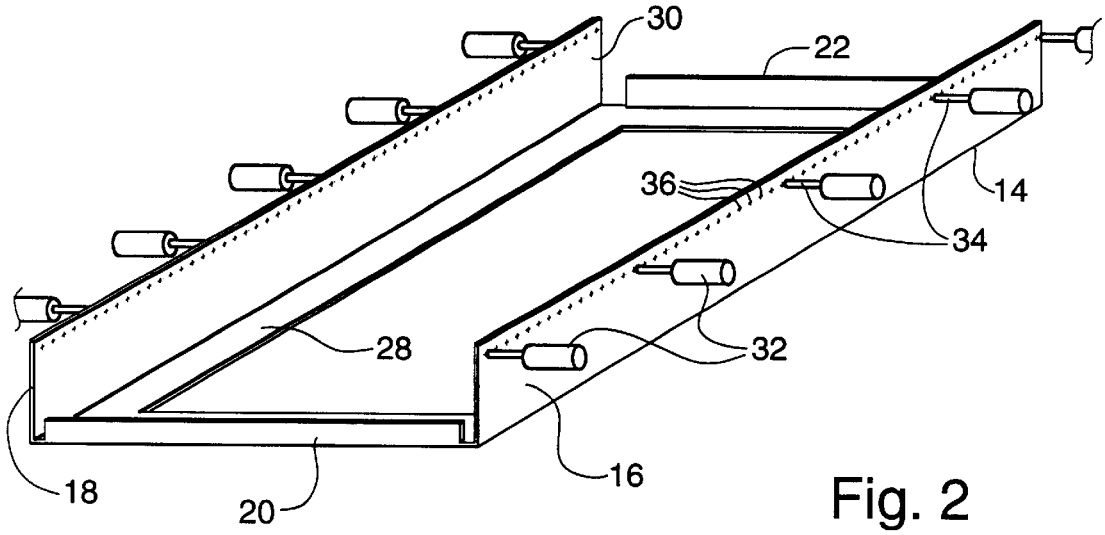
FIG. 2 is a perspective view of a tension mask frame having cylinders located along it long sides.

During the procedure of attaching the tension mask to the frame, the frame must be compressed. An improved method for compressing the tension mask frame includes the use of spaced actuators, such as gas or liquid actuated cylinders or any other pushers, that provide specific forces at different positions on the frame. These separate specific forces compress the frame to achieve a desired tension distribution within the tension mask, when it is attached to the frame. FIG. 2 shows the peripheral frame 14 prior to attachment of a tension mask thereto. A plurality of cylinders 32 are positioned with their piston rods 34 pressing against the second flanges 30 of the long sides 16 and 18 of the frame 14. Although only ten cylinders 32 are shown in FIG. 2, five on each opposite long side of the frame, additional cylinders can be used at each of the locations 36 indicated by plus signs, +. For example, in a preferred embodiment for a mask frame of a tube having a 68 cm (27 inch) diagonal, thirty two (32) cylinders are used along each of the long sides of the frame to compress the two long side flanges 30 toward each other.

Each of the cylinders 32 is preferably individually controlled to exert a desired force at a particular actuator location. The use of a plurality of actuators at an equal plurality of locations along each long side, 16 and 18, of the frame 14 permits the programming of varied forces along the frame sides. By using a plurality of actuators, the achievable tension distributions are essentially unlimited. Because the force distribution can be programmed, it is possible to achieve force distributions that are symmetric, asymmetric, or have more irregular variations.

Frame deflection (upon release of the compression) ultimately provides the force to tension the mask; and, in the present method, the frame deflection need not be fixed, but can vary in ways that will accommodate shape irregularities in the frame. Because the force provided by each cylinder can be individually controlled, a wide range of force distributions can be easily obtained. The cylinders can also be pressurized from the same source in pairs or other combination, to assure symmetry of the force distribution. The rate and sequence of force application can also be programmed. Furthermore, if needed, cylinders can also be located inside the frame to push outward at some locations to enhance the tension distribution in the mask.

The frame acts as a spring, with its spring constant varying along the length of its sides, that converts deflection into force. The elastic nature of the frame, that is, its tendency to return to an unstressed state, provides the tensioning force required for the mask. The present method of compressing the support frame accommodates both shape and structural differences in the frame. The frame resists whatever force is applied to it. In turn, the frame will exert this same force on the mask attached to it after an actuator force is removed. The result is that the mask tension distribution mimics the actuator force distribution, except for a small spring-back effect. In effect, using the present method, achieving the proper mask tension is largely insensitive to the frame structure and geometry.

Although a preferred embodiment for practicing the present invention includes fluid activated cylinders, it should be appreciated that the invention could also be practiced with other types of force-applying sources, such as drive screws, magnets, vacuum, etc.

What is claimed is:

1. A method of attaching a tension mask to a frame to achieve differing tensions at a plurality of locations across said mask, said frame having two opposite sides between which said mask is to be attached, comprising applying specific forces from each of a plurality of separate actuators at positions along each of said two opposite sides of said frame that affect the mask tensions respectively at said plurality of locations across said mask, said actuators being individually controlled to apply differing specific forces to said frame sides that are directly related to the desired mask tensions required at particular mask location locations, attaching the mask to said two opposite sides, and releasing said specific forces applied to the two opposite sides of said frame, whereby a mask tension distribution is achieved that is related to the actuator force distribution, and that is largely insensitive to frame structure and geometry.

2. The method as defined in claim 1, wherein forces are applied to each of said opposite sides of said frame by actuators at least at five locations along each side.

3. The method as defined in claim 1, wherein said separate actuators are fluid activated cylinders.

4. The method as defined in claim 3, wherein said cylinders include gas driven piston rods that provide the forces applied to said cylinders.

5. The method as defined in claim 3, wherein said cylinders include liquid driven piston rods that provide the forces applied to said cylinders.

6. A method of attaching a tension mask to a frame to achieve desired tensions at a plurality of locations across said mask, said frame having two opposite sides between which said mask is to be attached, comprising applying specific forces from each of a plurality of separate actuators at positions along each of said two opposite sides of said frame that affect the mask tensions respectively at said plurality of locations across said mask, each of said actuators being individually programmed to apply a specific force to said mask that is directly related to the desired mask tension required at a particular mask location, and attaching the mask to said two opposite sides, and releasing said specific forces applied by said programmed actuators to the two opposite sides of said frame, whereby a mask tension distribution is achieved that is related to the actuator force distribution, and that is largely insensitive to frame structure and geometry.

* * * * *